US010449791B2

(12) United States Patent
Moehringer et al.

(10) Patent No.: US 10,449,791 B2
(45) Date of Patent: Oct. 22, 2019

(54) DIGITAL PRINTING MACHINE

(71) Applicant: HEIDELBERGER DRUCKMASCHINEN AG, Heidelberg (DE)

(72) Inventors: Markus Moehringer, Weinheim (DE); Jens Friedrichs, Neckargemuend (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 15/692,409

(22) Filed: Aug. 31, 2017

(65) Prior Publication Data

US 2018/0072076 A1 Mar. 15, 2018

(30) Foreign Application Priority Data

Sep. 13, 2016 (DE) ..... 10 2016 217 392

(51) Int. Cl.

| | |
|---|---|
| ***B41J 13/22*** | (2006.01) |
| ***B41J 11/00*** | (2006.01) |
| ***B41J 13/08*** | (2006.01) |
| ***B65H 85/00*** | (2006.01) |
| ***B65H 5/12*** | (2006.01) |
| ***B65H 5/22*** | (2006.01) |

(52) U.S. Cl.

CPC ..... *B41J 13/226* (2013.01); *B41J 11/002* (2013.01); *B41J 11/007* (2013.01); *B41J 13/08* (2013.01); *B65H 5/12* (2013.01); *B65H 5/224* (2013.01); *B65H 85/00* (2013.01); *B41J 11/0085* (2013.01); *B65H 2404/27* (2013.01); *B65H 2801/15* (2013.01)

(58) Field of Classification Search

None

See application file for complete search history.

(56) References Cited

U.S. PATENT DOCUMENTS

| | | | | |
|---|---|---|---|---|
| 6,796,647 | B2 | 9/2004 | Kosaka et al. | |
| 2003/0081053 | A1* | 5/2003 | Barinaga | B41J 2/16547 347/32 |
| 2004/0125187 | A1* | 7/2004 | Kosaka | B41J 11/002 347/102 |
| 2004/0246324 | A1 | 12/2004 | Nakashima | |

(Continued)

FOREIGN PATENT DOCUMENTS

| | | | |
|---|---|---|---|
| DE | 60211492 | T2 | 11/2006 |
| DE | 102006009484 | B4 | 3/2010 |

(Continued)

*Primary Examiner* — Erica S Lin

(74) *Attorney, Agent, or Firm* — Laurence A. Greenberg; Werner H. Stemer; Ralph E. Locher

(57) ABSTRACT

A digital printing machine includes a first sheet-conveying belt made of a first material, a second sheet-conveying belt made of a second material, and a print head for printing on a front side and a back side of the print sheet. The print head is directed towards the first sheet-conveying belt. A reversing device reverses the print sheet between receiving a print on the front side and receiving a print on the back side. A drier dries a print that has been printed onto the print sheet by the print head. The drier is directed towards the second sheet-conveying belt. For instance, the first sheet-conveying belt may be a metal belt and the second sheet-conveying belt may be a plastic belt.

12 Claims, 2 Drawing Sheets

(56) References Cited

U.S. PATENT DOCUMENTS

| | | | | |
|---|---|---|---|---|
| 2007/0008394 | A1* | 1/2007 | Mashima | B41J 3/60 347/104 |
| 2010/0238249 | A1* | 9/2010 | Panides | B41J 11/007 347/104 |
| 2011/0234724 | A1* | 9/2011 | Hoover | B41J 25/3082 347/102 |

FOREIGN PATENT DOCUMENTS

| | | | |
|---|---|---|---|
| EP | 1375167 | A2 | 1/2004 |
| EP | 2505368 | A1 | 10/2012 |

* cited by examiner

DIGITAL PRINTING MACHINE

CROSS-REFERENCE TO RELATED APPLICATION

This application claims the priority, under 35 U.S.C. § 119, of German Patent Application DE 10 2016 217 392.8, filed Sep. 13, 2016; the prior application is herewith incorporated by reference in its entirety.

BACKGROUND OF THE INVENTION

Field of the Invention

The present invention relates to a digital printing machine having a print head, a reversing device, and a drier.

German Patent DE 10 2006 009 484 B4 describes such a printing machine, which further includes a transport belt and a counter-pressure belt. The print head is associated with the transport belt. The counter-pressure belt supports the sheets as they are being reversed. No information is given on the material of the transport belt.

Hypothetically, the transport belt might be a plastic belt. If the transport belt was a plastic belt, it would run the risk of noticeable belt elongation over time because plastic has a tendency towards material fatigue. That would be detrimental to the quality of the print.

SUMMARY OF THE INVENTION

It is accordingly an object of the invention to provide a digital printing machine, which overcomes the hereinaforementioned disadvantages of the heretofore-known machines of this general type and which ensures both high print quality and a high degree of drying efficiency.

With the foregoing and other objects in view there is provided, in accordance with the invention, a digital printing machine, comprising a first sheet-conveying belt made of a first material, a second sheet-conveying belt made of a second material, and a print head for printing on the front side and the back side of a print sheet, wherein the print head is directed towards the first sheet-conveying belt. The digital printing machine of the invention further includes a reversing device for reversing the print sheet between being printed on the front side and being printed on the back side, and a drier for drying a print that has been printed onto the print sheet by using the print head, the drier being directed towards the second sheet-conveying belt.

In the machine of the invention, it is not one and the same belt that transports the sheet past the print head and past the drier. This means that the materials of the two belts may be optimized in terms of the differing requirements resulting from interactions with the print head and the drier. The material of the first sheet-conveying belt may be selected specifically to meet the requirements resulting from interaction with the print head and the material of the second sheet-conveying belt may be selected specifically to meet the requirements resulting from interacting with the drier. The individual adaptation of the belt materials guarantees high print quality and a high degree of efficiency of the drying action.

Various further developments of the digital printing machine of the invention are possible. The first material may be more dimensionally stable than the second material. For instance, the first sheet-conveying belt may be a metal belt. The second material may have better thermal insulation properties than the first material. Thus, if the second material is a bad thermal conductor, the heat transmitted to the sheet by the drier is not easily transferred to the second sheet-conveying belt. The second sheet-conveying belt may for instance be a plastic belt. The first sheet-conveying belt may be a vacuum belt for holding the print sheet by suction, and the second sheet-conveying belt may likewise be a vacuum belt for holding the print sheet by suction. The print head may be an inkjet print head.

Other features which are considered as characteristic for the invention are set forth in the appended claims.

Although the invention is illustrated and described herein as embodied in a digital printing machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
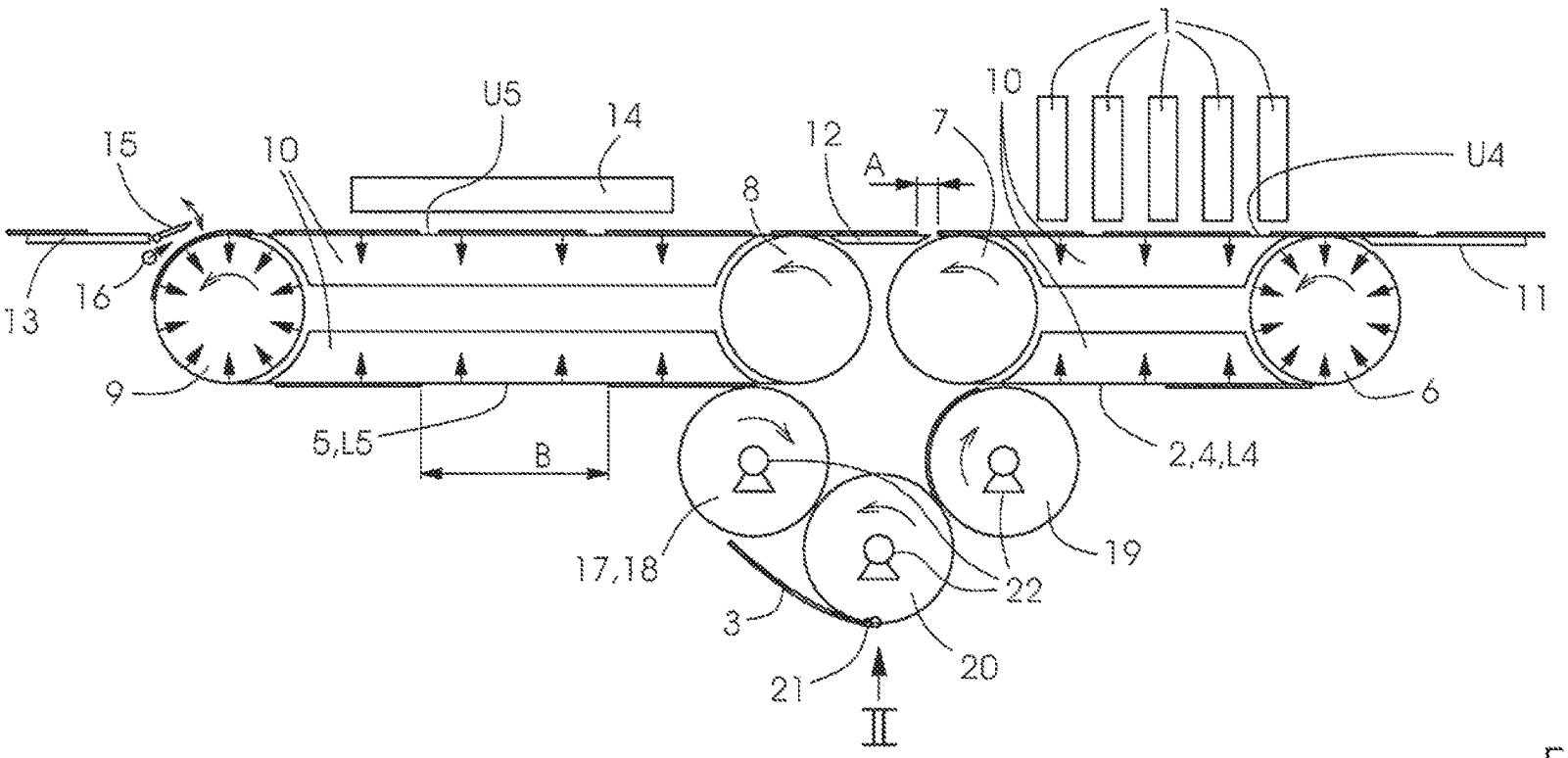
FIG. 1 is an overall, diagrammatic, longitudinal-sectional view of a digital printing machine including a reversing device.

Referring now to the figures of the drawings in detail and first, particularly, to FIG. 1 thereof, there is seen a digital printing machine having a plurality of print heads 1. Alternatively, only one such print head 1 may be provided. The print head 1 or every print head 1 operates in a contact-free way (known as NIP or Non-Impact Printing) and is preferably an inkjet print head.

A conveyor belt device 2 transports print sheets 3 made of paper, cardboard, or foil through the digital printing machine. The conveyor belt device 2 includes a first sheet-conveying belt 4 and a second sheet-conveying belt 5. The first sheet-conveying belt 4 is guided by a first deflection roller 6 and a second deflection roller 7. The second sheet-conveying belt 5 is guided by a third deflection roller 8 and a fourth deflection roller 9. As is indicated by the arrows, a vacuum is applied to the insides of the first and fourth deflection rollers 6, 9. The first and fourth deflection rollers 6, 9 are used to apply the vacuum to the sheet-conveying belts 4, 5. Every sheet-conveying belt 4, 5 has an upper strand U4, U5, a lower strand L4, L5, and vacuum chambers 10 disposed therebetween in suction air conducting connection with the sheet-conveying belts 4, 5. The suction air is applied to the upper and lower strands by using the vacuum chambers 10, which are open towards the respective sheet-conveying belts 4 and 5. The sheet-conveying belts 4, 5 are thus vacuum belts and have through holes for holding the print sheets 3 by suction. If there is not too much distance between the upper and lower strands, the two vacuum chambers 10 of each sheet-conveying belt 4, 5 may be combined to form a common vacuum chamber.

The upper strands of the two sheet-conveying belts 4, 5 are located in a common horizontal plane, in which a feed table 11, a transfer table 12, and a delivery table 13 for the print sheets 3 are likewise disposed. Instead of the feed table 11 and delivery table 13, there may be drums or other devices for feeding and delivering the print sheets. The lower strands of the two sheet-conveying belts 4, 5 are likewise located in a common horizontal plane. The print heads 1 for printing on the conveyed print sheets 3 are directed towards the first sheet-conveying belt 4 in the region of the upper strand thereof.

The first sheet-conveying belt 4 is made of a different material than the second sheet-conveying belt 5. In more concrete terms, the first sheet-conveying belt 4 may be a metal belt, e.g. made of steel, and the second sheet-conveying belt 5 may be a plastic belt, e.g. made of polyurethane.

The metal belt (first sheet-conveying belt 4) has a high degree of dimensional stability, in particular in terms of a lengthening of the belt, a feature which is advantageous for achieving high-quality prints in its interaction with the print heads 1. The first sheet-conveying belt 4 has a higher degree of dimensional stability than the second sheet-conveying belt 5. The metal material of the first sheet-conveying belt 4 allows a particularly delicate suction structure formed of a large number of through holes to be formed. Small-diameter through holes may be created in a grid having a small grid width, for instance in a laser treatment process. The delicate suction structure is advantageous in terms of holding the print sheet 3 with little deformation but nevertheless securely, aspects that are of particular importance in a printing operation.

The plastic belt (second sheet-conveying belt 5) has good thermal insulation properties, i.e. it is a bad thermal conductor, an aspect that is advantageous for achieving a high degree of efficiency in its interaction with a drier 14. The drier 14 is used to dry (completely or partly/pinning) prints on the print sheets 3. The second sheet-conveying belt 5 has better thermal insulation properties, i.e. it is less thermally conductive than the first sheet-conveying belt 5. The plastic material of the second sheet-conveying belt 5 reduces the transfer of heat introduced by the drier 14 from the print sheet 3 to the second sheet-conveying belt 5. The suction structure of the second sheet-conveying belt 5 may be less delicate than the one of the first sheet-conveying belt 4 because the drying process does not have such high requirements in terms of the positional stability of the sheets as the printing operation.

A blow tube 16 or a comparable blowing device is directed towards a space between a switch 15 and the fourth deflection roller 9.

A reversing device 17, which is only active in a perfecting printing mode of the digital printing machine, is disposed under the conveying-belt device 2. In a straight printing mode of the digital printing machine, the reversing device 17 is passive and does not transport any sheets. The reversing device 17 includes a first vacuum drum 18, a second vacuum drum 19, and a reversing drum 20 which is disposed therebetween and includes clamping grippers 21 for clamping the respective print sheet 3. The clamping grippers 21 are embodied as pliers-type grippers. Such a pliers-type gripper has a gripper finger and a gripper pad, which are jointly pivotable relative to the reversing drum 20. In the two-side printing mode, the clamping grippers 21 grip the trailing edge of the print sheet 3 on the first vacuum drum 18. In addition to the clamping grippers 21, the reversing drum 20 may additionally include vacuum openings for holding the print sheet 3. The first and second vacuum drums 18, 19 do not have any clamping grippers 21 for holding the print sheet 3, rather they exclusively hold the print sheet 3 in a pneumatic way.

Every sheet-conveying belt 4, 5 has a belt length that is an integer multiple of a circumferential length of every drum 18 to 20. The circumferential length of every deflection roller 6 to 9 corresponds to the circumferential length of every drum 18 to 20. The deflection rollers 6 to 9 and the drums 18 to 20 have the same diameter. The first vacuum drum 18 is disposed between the second sheet-conveying belt 5 and the reversing drum 20 to transfer the print sheets 3 from the former to the latter. The second vacuum drum 19 is disposed between the reversing drum 20 and the first sheet-conveying belt 4 to transfer the print sheets 3 from the former to the latter. Each one of the drums 18 to 20 has a direct drive 22 so that the reversing device 17 is adjustable to different format lengths of the print sheets 3. The adjustment is achieved by actuating the direct drives 22 in a corresponding way.

Figure 2:
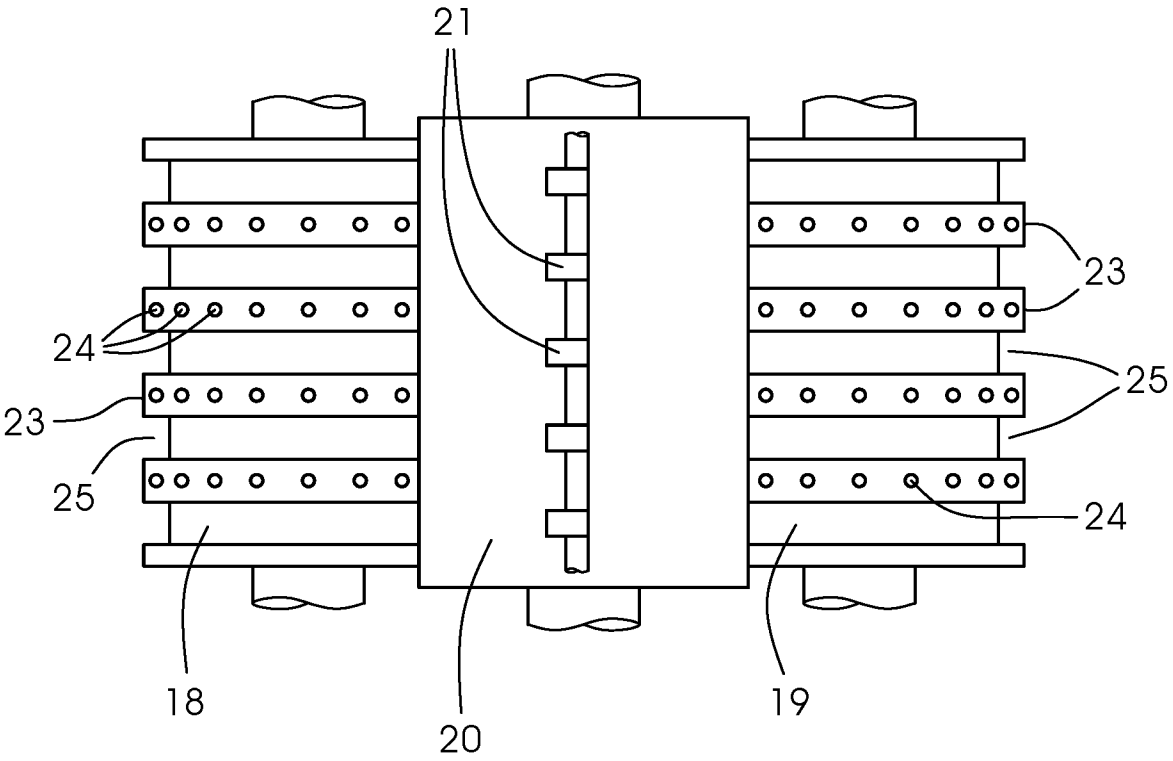
FIG. 2 is a fragmentary, bottom-plan view of the reversing device as seen along the direction of an arrow II in FIG. 1.

FIG. 2 illustrates the reversing device 17 as seen from the viewing direction II indicated in FIG. 1, but without any print sheet 3. The first and second vacuum drums 18, 19 are of identical construction and have annular ribs 23 for supporting the print sheets 3. Suction openings 24 that form a row of equidistant openings 24 along the respective annular rib 23 terminate in every annular rib 23. The suction openings 24 are used to hold the print sheets 3 by suction. Annular grooves 25 having side walls which are formed by the annular ribs 23 are formed between the annular ribs 23. The annular grooves 25 have a depth and a width that allow the clamping grippers 21 to dip into the annular grooves 25 without collision.

In the first-side printing mode, the digital printing machine operates as follows: when the print sheets 3 are taken from the feed table 11 by the first sheet-conveying belt 4, they are disposed in such a way that their sheet edge distance A is at a minimum and almost zero. The attraction of the print sheets 3 to the first sheet-conveying belt 4 occurs in the wrap-around region of the first deflection roller 6 and is assisted by the suction effect of the latter. The first sheet-conveying belt 4 transports the print sheets 3 past the print heads 1, where every print sheet 3 receives a multicolor print on its front side. If there is only one print head 1 as mentioned in the alternative, the front side receives only a single-color print. As they are transported past the print heads 1, the print sheets 3 are held on the upper strand due to the effect of the vacuum applied thereto. Having been printed on, the print sheets 3 are transferred from the first sheet-conveying belt 4 to the second sheet-conveying belt 5 by the transfer table 12. As they are transported past the drier 14 by the second sheet-conveying belt 5, the print sheets 3 are irradiated by the drier 14, for instance with hot air or infrared radiation or laser radiation. In the straight printing mode, the switch 15 permanently remains in a first switching position, which is not shown in the figure. In the first switching position, the switch is in a common horizontal plane with the upper strand of the second sheet-conveying belt 5 and the delivery table 13. All print sheets 3 coming from the second sheet-conveying belt 5 are guided to the delivery table 13 by the switch 15, while the blow tube 16 is deactivated.

In the perfecting printing mode, the digital printing machine operates as follows: coming from the feed table 11, the print sheets 3 are fed to the first sheet-conveying belt 4 at half the sheet-conveying cycle to create sheet gaps B between the print sheets 3 that are being fed. The length of every sheet gap B corresponds to the sum of the format length of the print sheets 3 and twice the distance A. In the region of the first deflection roller 6, i.e. upstream of the print heads 1, the first sheet-conveying belt 4 inserts a print sheet 3 that has already been printed on its front side into every sheet gap B that has been created in the sheet-feeding process. The result is a gapless stream of print sheets 3 with every print sheet 3 on an even-numbered space having already been printed on its front side and every print sheet 3 on an odd-numbered space still unprinted on its front and back sides. When this stream of sheets passes the print heads 1, they alternatingly print on the back side of a print sheet 3 on an even-numbered space and on the front side of a print sheet 3 on an odd-numbered space.

The print sheets 3 are then transported to the switch 15 and dried in the way described in the context of the single-side printing mode.

In the perfecting printing mode, the switch 15 is periodically switched in accordance with the sheet-conveying cycle. For every print sheet 3 arriving on an even-numbered space, i.e. every sheet that has been printed on both sides, the switch 15 is in the first switching position corresponding to the straight printing mode, causing the print sheet 3 to be guided to the delivery table 13 by the switch 15. For every print sheet 3 arriving on an odd-numbered space, i.e. every sheet that has only been printed on one side, the switch 15 is in a second switching position as shown in the figure. In this second switching position, the print sheet 3 is not guided to the delivery table 13, but to the reversing device 17. In this process, the print sheet 3, together with the second sheet-conveying belt 5, is deflected by the fourth deflection roller 9. The vacuum applied to the second sheet-conveying belt 5 by the fourth deflection roller 9 and the blow tube 16, which is activated in the perfecting printing mode, causes the print sheet 3 to be held on the second sheet-conveying belt 5 in the deflection region. While it is transported to the first vacuum drum 18 by the lower strand of the second sheet-conveying belt 5, the print sheet 3, which has been deflected in a downward direction, is securely held on the lower strand due to the vacuum applied thereto.

The vacuum applied to the suction openings 24 in the front circumferential region of the first vacuum drum 18, i.e. in the region that corresponds to the leading sheet edge of the print sheet 3, is stronger than in the rest of the circumferential region. The stronger vacuum is provided to take over the leading edge of the print sheet 3 from the second sheet conveyor 5. In the front circumferential region, the suction effect of the first vacuum drum 18 on the print sheet is greater than the suction effect of second sheet-conveying belt 5 on the print sheet 3, so that during the transfer of the sheet, the suction effect of the first vacuum drum 18 overcomes the suction effect of the second sheet-conveying belt 5. The weaker vacuum applied to the suction openings 24 in the remaining circumferential region of the first vacuum drum 18 is sufficient to securely fix the print sheet 3 thereto. The first vacuum drum 18 transports the print sheet 3 until the trailing edge of the sheet is at the tangent point of the two drums 18 and 20.

At the tangential point, the clamping grippers 21 of the reversing drum 20 grip the trailing edge of the sheet and the reversing drum 20 takes the print sheet 3 from the first vacuum drum 18. The reversing drum 20 transfers the print sheet 3 to the second vacuum drum 19. The second vacuum drum 19 takes the print sheet 3 from the reversing drum 20 to transfer it to the first sheet-conveying belt 4. While the print sheet 3 rests on the second vacuum drum 19, the leading sheet edge, which used to be the trailing sheet edge prior to the reversing of the sheet, is held by a suction region of the second vacuum drum 19. A pulsed vacuum may be applied to the suction region holding the leading sheet edge so that the suction region may be deactivated once the print sheet 3 has been transferred to the lower side of the first sheet-conveying belt 4. The print sheet 3 that has been taken over by the first sheet-conveying belt 4 is conveyed upward along the wrap-around region of the first deflection roller 6 and in the region between the feed table 11 and the print heads 1, with the print sheet 3 being inserted into the sheet gap B that has been provided in the stream of sheets coming from the feed table 11.

The print heads 1 then print onto the second sheet side of the print sheet 3, which has already been printed on one side and subsequently the print on the back side is dried in the drier 14. The print sheet 3, which has now received a print on both sides, is then transported to the delivery table 13 by the switch 15, which is in the same switching position as in the straight printing mode.

Since sheet gaps B are present in the stream of sheets on the lower strands of the sheet-conveying belts 4, 5, the direct drives 22 may cause a phase adjustment of the reversing device 17 relative to the conveyor belt device 2 while a sheet gap B passes the reversing device 17. In this phase adjustment, the drums 18 to 20 are temporarily accelerated or decelerated. Thus, in the perfecting printing mode, the drums 18 to 20 rotate at an uneven speed, whereas they rotate at a constant speed while the print sheet 3 is transported by the drums 18 to 20.

The invention claimed is:

1. A digital printing machine, comprising:

a first sheet-conveying belt made of a first material;

a second sheet-conveying belt made of a second material being a different material than said first material, said second sheet-conveying belt being a plastic belt;

a print head for printing on a front side and a back side of a print sheet, said print head being directed towards said first sheet-conveying belt;

a reversing device for reversing the print sheet between receiving a print on the front side and receiving a print on the back side, said reversing device including a first vacuum drum, a second vacuum drum and a reversing drum disposed between said first vacuum drum and said second vacuum drum, said reversing drum including grippers for clamping the print sheet; and a drier for drying a print that has been printed onto the print sheet by using said print head, said drier being directed towards said second sheet-conveying belt.

2. The digital printing machine according to claim 1, wherein said first sheet-conveying belt is a metal belt.

3. A digital printing machine, comprising:

a first sheet-conveying belt made of a first material;

a second sheet-conveying belt made of a second material, said second material being a different material than said first material;

a print head for printing on a front side and a back side of a print sheet, said print head being directed towards said first sheet-conveying belt;

a reversing device for reversing the print sheet between receiving a print on the front side and receiving a print on the back side, said reversing device including a first vacuum drum, a second vacuum drum and a reversing drum disposed between said first vacuum drum and said second vacuum drum, said reversing drum including grippers for clamping the print sheet; and a drier for drying a print that has been printed onto the print sheet by using said print head, said drier being directed towards said second sheet-conveying belt.

4. The digital printing machine according to claim 1, wherein said first sheet-conveying belt is a vacuum belt for holding the print sheet by suction.

5. The digital printing machine according to claim 1, wherein said second sheet-conveying belt is a vacuum belt for holding the print sheet by suction.

6. The digital printing machine according to claim 1, wherein said print head is an inkjet print head.

7. The digital printing machine according to claim 1, wherein said first sheet-conveying belt has a first sheet-conveying belt upper strand and said second sheet-conveying belt has an second sheet-conveying belt upper strand, said first sheet-conveying belt upper strand and second sheet-conveying belt upper strand are coplanar.

8. The digital printing machine according to claim 3, wherein said first sheet-conveying belt is a metal belt.

9. The digital printing machine according to claim 3, wherein said first sheet-conveying belt is a vacuum belt for holding the print sheet by suction.

10. The digital printing machine according to claim 3, wherein said second sheet-conveying belt is a vacuum belt for holding the print sheet by suction.

11. The digital printing machine according to claim 3, wherein said print head is an inkjet print head.

12. The digital printing machine according to claim 3, wherein said first sheet-conveying belt has a first sheet-conveying belt upper strand and said second sheet-conveying belt has an second sheet-conveying belt upper strand, said first sheet-conveying belt upper strand and second sheet-conveying belt upper strand are coplanar.

* * * * *